US007044236B2

(12) United States Patent
Iversen et al.

(10) Patent No.: US 7,044,236 B2
(45) Date of Patent: May 16, 2006

(54) SHOT DIRECTION INDICATING DEVICE

(75) Inventors: Morten Iversen, Bergen (NO); Kenneth Latveit, Stavanger (NO); Knut Henriksen, Stavanger (NO); Kristian Vargervik, Stavanger (NO); Tim V. Sampson, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 498 days.

(21) Appl. No.: 10/028,082

(22) Filed: Dec. 22, 2001

(65) Prior Publication Data

US 2003/0116353 A1 Jun. 26, 2003

(51) Int. Cl.
*E21B 43/117* (2006.01)

(52) U.S. Cl. ..... 175/4.51; 166/255.2; 166/297

(58) Field of Classification Search ..... 166/255.2, 166/297, 55, 55.1, 298; 175/45.1
See application file for complete search history.

(56) References Cited

U.S. PATENT DOCUMENTS 4,410,051 A 10/1983 Daniel et al.
4,637,478 A 1/1987 George
5,273,121 A 12/1993 Kitney et al.
5,799,732 A * 9/1998 Gonzalez et al. ..... 166/250.07
5,964,294 A 10/1999 Edwards et al.
2002/0185275 A1 12/2002 Yang et al.

FOREIGN PATENT DOCUMENTS

GB 2 374 887 A 10/2002

* cited by examiner

*Primary Examiner*—William Neuder
(74) *Attorney, Agent, or Firm*—Darryl M. Springs; Timothy M. Donoughue; Keith R. Derrington

(57) ABSTRACT

One embodiment of the present invention discloses a shot indication device that indicates the orientation of a downhole tool that is inside of a wellbore at a particular time. The shot indication device can also be used to determine the orientation of a perforating gun with shaped charges at the instant the shaped charges are detonated. The shot indication device is comprised of an indicator housing secured within the downhole tool. Formed within the indicator housing is an annulus whose axis is parallel to the axis of the downhole tool. Disposed inside of the annulus is an indicator element that freely moves about the circumference of the annulus.

10 Claims, 2 Drawing Sheets

SHOT DIRECTION INDICATING DEVICE

BACKGROUND OF THE INVENTION

1. Field of the Invention

The invention relates generally to the field of oil and gas well services. More specifically, the present invention relates to an apparatus that provides positive indication of orientation of perforating guns disposed within a wellbore.

2. Description of Related Art

The orientation of perforating guns is the subject of many prior art patents. These patents include Daniel, U.S. Pat. No. 4,410,051, Kitney, U.S. Pat. No. 5,273,121, George, U.S. Pat. No. 4,637,478 and Edwards, U.S. Pat. No. 5,964,294. Orienting perforating guns in deviated wells enables the well operator to aim the shaped charges of the perforating gun at specific radial locations along the circumference of the wellbore. This is desired because the potential oil and gas producing zones of each specific well could exist at any radial position or region along the outer wellbore circumference. These potential producing zones around the deviated well dictate the desired orientation of a perforating gun to ensure that the shaped charges perforate the casing adjacent a potential producing zone.

Because perforating guns are often thousands of feet below the surface of the earth during the perforation process, it is difficult to determine if the perforating gun is in the desired orientation at the instant the shape chargers are detonated. Knowing the orientation of the perforation gun during detonation can be useful to the well operators. If the gun is not in the desired orientation, adjustments can be made to the tool so that it is properly oriented in subsequent operations. Alternatively, if the perforating gun was well out of the orientation tolerances when the well was perforated, the possibility exists of sand entering the wellbore. Having knowledge of potential sand production due to errant shaped charge position, the well operators could consider corrective action to address errant perforations. The corrective action includes gravel packing operations to curb any sand production and possibly shutting off the sand producing portion of the wellbore and drilling an alternative bore around that section. Because these operations are very expensive the well operators must have reliable evidence of perforation shot orientation before undertaking such corrective action. Accordingly there currently exists a need by which the actual orientation of the perforating gun can be readily discerned from a quick examination of the perforating gun after the perforation process.

BRIEF SUMMARY OF THE INVENTION

One embodiment of the present invention discloses an apparatus for use in more effectively placing perforations in a hydrocarbon producing wellbore comprising an elongated housing formed for axial insertion into said wellbore. The elongated housing includes one or more shaped charges disposed within and an indicator mechanism created from a deformable material. The indicator mechanism is secured within the elongated housing and formed to comprise an annulus therein. The annulus has an inner surface and an outer surface that form opposing sides and the annulus axis is parallel to the elongated housing axis. Disposed within the annulus is an indicator element that is freely moveable within the annulus, such that upon rotation of the elongated housing the indicator element responds to gravitational forces and moves along the annulus to a location closest to the source of the gravitational forces. The opposing sides of the annulus are malleable and deformable and can be squeezed together to secure the indicator element between the opposing sides locking it into a stationary position. Because the stationary position is the low point of the annulus, analysis of the downhole tool after it is retrieved from the wellbore can reflect the orientation of the downhole tool when the opposing sides were squeezed together. One way in which the sides can be squeezed together is by detonation of a detonation cord placed close to the axis of the inner surface which in turn urges the inner surface against the outer surface thereby trapping the indicator element between the opposing sides at the point where the annulus is at its lowest.

DETAILED DESCRIPTION OF THE INVENTION

Figure 1:
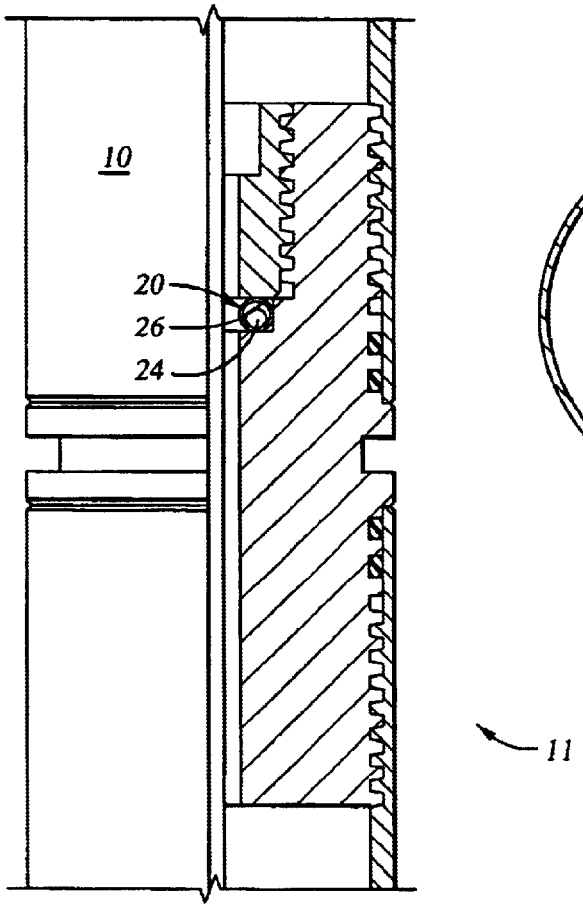
FIG. 1 illustrates a partial cut away of a downhole tool including the shot orientation indication device.
Figure 2:
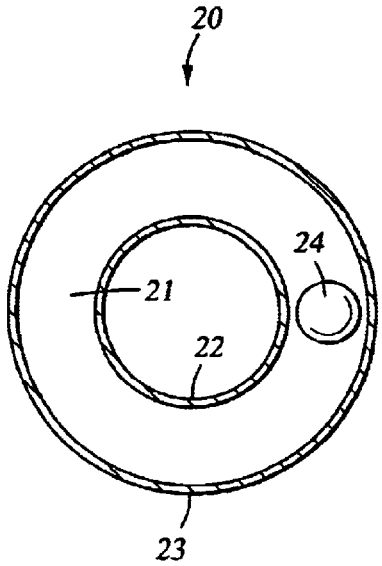
FIG. 2 illustrates a cross-sectional view of the indicator mechanism.

With reference to the drawing herein, a shot orientation indication device according to one embodiment of the present invention is shown in FIG. 1. The cross sectional view of FIG. 1 illustrates the indicator mechanism 20 co-axially situated within a downhole tool 10. The downhole tool 10 can be any device used in subterranean well operations, including perforating guns, logging devices, or any other device adapted for operations in a well bore. Further, the downhole tool 10 is capable of being used with a wireline, a tractor sub, or can be tubing conveyed. With respect to the present invention, the downhole tool 10 has an elongated housing 11 and includes shaped charges (not shown).

The indicator mechanism 20 is comprised of a generally circular inner surface surrounded by an also circular outer surface 23. The combination of the inner surface 22 surrounded by the outer surface 23 creates an annulus 21 between the two opposing surfaces. Disposed within the annulus 21 is an indicator element 24. The respective sizes of the annulus 21 and the indicator element 24 are such that the indicator element 24 can freely move about the entire circumference of the annulus 21 in either a clockwise or a counter-clockwise direction.

Figure 3:
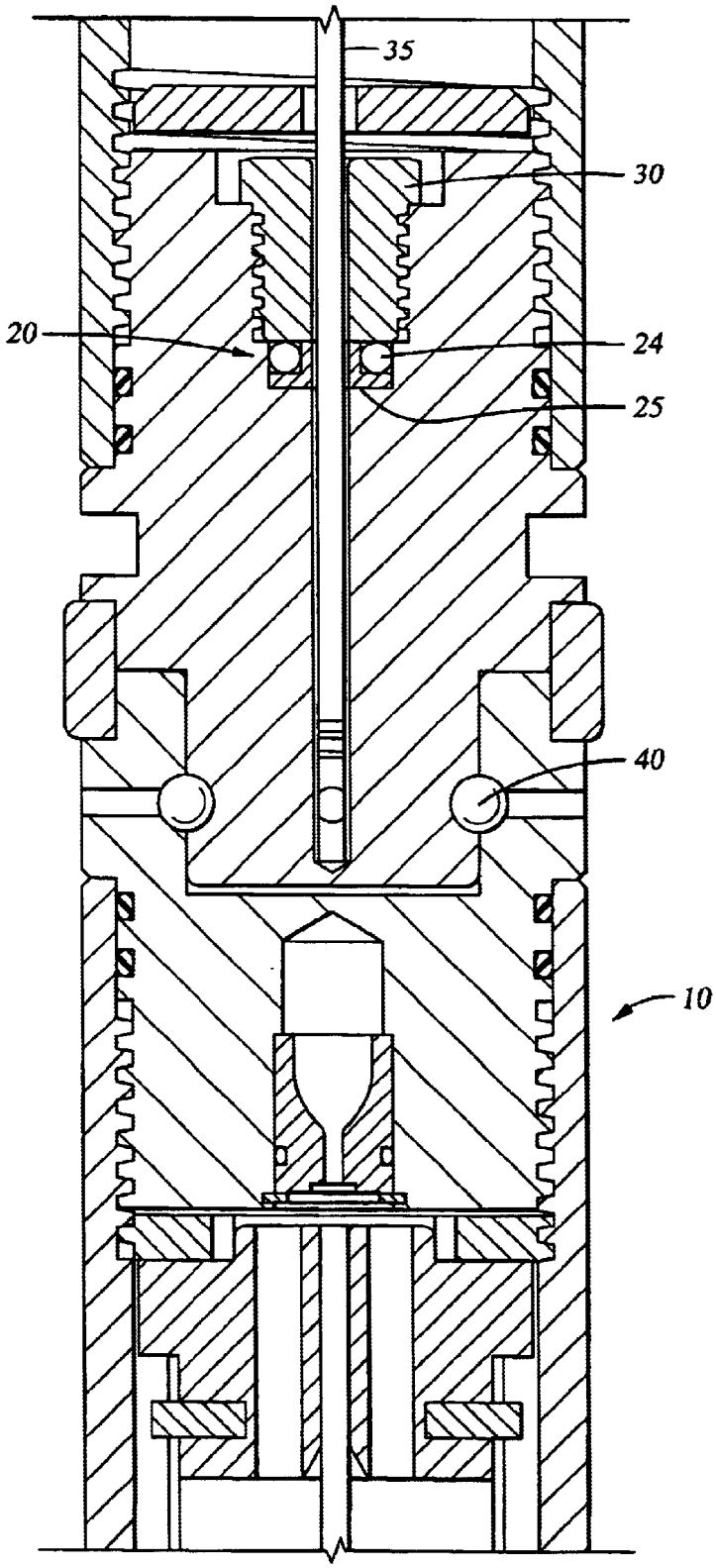
FIG. 3 depicts a cross-sectional view of a perforating gun including the indicator mechanism.

As shown in FIGS. 1 and 3, the indicator mechanism 20 further comprises an upper surface 26 and a lower surface 25. The combination of these four surfaces operates to create an annulus 21 that fully encloses the indicator element 24. However, alternative embodiments of the indicator mechanism 20 exist. These include shapes where the inner surface 22 and the outer surface 23 have top and bottom ends that are curved toward the opposing surface member to provide a support or containment means for the indicator element 24. As shown in the accompanying figures though, the inner surface 22 and the outer surface 23 are substantially cylindrical and have a radius that is much larger than the length of the cylinder.

The inner surface 22 should be comprised of a material having a modulus of elasticity of sufficient magnitude to resist deformation when being coupled with the downhole tool 10, as well as when the downhole tool 10 is being inserted into a wellbore, including deviated wellbores. Additionally, the material of the inner surface 22 should be sufficiently ductile and tough to be plastically deformed without suffering catastrophic failure. Accordingly, the preferred material for the inner surface 22 is brass, but it could also be made from other malleable materials such as carbon steel, stainless steel, or copper.

The indicator element 24 should be manufactured from a highly elastic and hard material to enable it to freely revolve around the annulus 21 with a minimum amount of rolling resistance. Therefore it is preferred that the indicator element 24 be formed from stainless steel, but it can also be made from other materials having high coefficients of elasticity coupled with high Brinell hardness values. Similarly, because the indicator element 24 traverses the surface of the outer surface 23, the outer surface 23 should be constructed of a hard, yet elastic material. Preferably the outer surface 23 material is stainless steel, but other hard elastic materials could be used as well.

In the accompanying figures the indicator mechanism 20 is illustrated as being coaxial within the down hole tool 10. But the indicator mechanism 20 can be located at various locations within the down hole tool 10 inside of its elongated housing 11, as long as the axis of the indicator mechanism 20 is parallel to the axis of the down hole tool 10.

In FIG. 3 a detonation cord 35 is shown which acts as a fuse to detonate the shaped charges contained within the elongated housing 11. The detonation cord 35 is activated on one end and transfers the energy along its length to the shaped charges (not shown) where they in turn are detonated by the detonation cord 35 for perforating the sides of a well bore. The detonation cord 35 can be comprised of a material such as PRIMACORD®. It should be noted that while FIG. 3 illustrates a perforating gun having a swivelled action 40, the present invention can be used in downhole tools that have a single segment, as well as multiple segments that are connected together such as the one depicted in FIG. 3.

Figure 4:
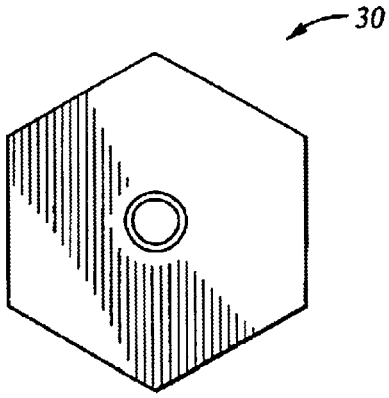
FIG. 4 depicts an overhead view of a locking nut.

The lock down nut 30 depicted in FIGS. 3 and 4 is shown to be threaded on an outer surface, and secured into the down hole tool 10. Sufficient tightening of the lock down nut 30 secures the indicator mechanism 20 within the down hole 10. It is well understood that the design parameters for creating the lock down nut 30 should be obvious to one skilled in the art.

In operation the downhole tool 10 containing the indicator mechanism 20 would be assembled at surface before insertion of the down hole tool 10 into a well bore. When the downhole tool 10 reaches the deviated section of the wellbore, it should begin to rotate until it is in its desired orientation as prescribed by the design of the downhole tool 10. During this time the inner and outer surfaces (22, 23) of the indicator mechanism 20 will rotate as well, thereby altering their angular position within the wellbore. However, the indicator element 24, which is not secured to either the inner or outer surface (22, 23) will move with respect to both surfaces and ultimately come to rest at the lowest point within the annulus 21.

In the case where the down hole tool 10 is a perforating gun, upon detonation of the detonation cord 35 a shock wave is produced of sufficient force to deform the inner surface 22 and impinge it against the outer surface 23. The material of the inner surface 22 deforms outward against the outer surface 23 and impinges the indicator element 24 securely in place against the outer surface 23. This location is the low point of the annulus 21 at the time of detonation. After the tool is retrieved from the well bore, examination of the position of the indicator element 24 with respect to the rest of the perforating gun, provides the well bore operators an indication of where the perforating charges were oriented when the shaped charges were detonated.

Figure 5:
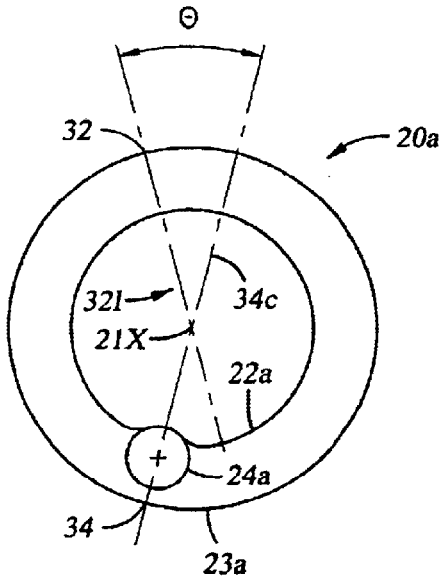
FIG. 5 illustrates a cross sectional view of one embodiment of a Short Orientation Indicator Device subsequent to use.

As shown in FIG. 5, a mark 32 can be scored within the annulus 21 on the inner surface or the outer surface 23, where the mark reflects the calculated or expected low point. Upon detonation of the perforating gun and the downhole tool 10 has been retrieved from the wellbore, the deviation between the actual low point 34 and the expected annulus low point 32 can be measured by the angle θ that is the angle formed by the intersection of the lines drawn through the axis of the annulus 21*x* to the mark 32, and the axis of the annulus 21*x* to the actual low point 34.

The present invention described herein, therefore, is well adapted to carry out the objects and attain the ends and advantages mentioned, as well as others inherent therein. While a presently preferred embodiment of the invention has been given for purposes of disclosure, numerous changes in the details of procedures for accomplishing the desired results. Such as the utilization of non-metallic materials in the construction of the elements of the indicator mechanism 20. These and other similar modifications will readily suggest themselves to those skilled in the art, and are intended to be encompassed within the spirit of the present invention disclosed herein and the scope of the appended claims.

What is claimed is:

1. An apparatus to determine wellbore perforation orientation comprising:

an elongated housing formed for axial insertion into said wellbore;

one or more shaped charges disposed within said housing;

an indicator mechanism created from a deformable material secured within said elongated housing, said indicator mechanism formed to comprise an annulus formed within, said annulus having an inner surface and an outer surface forming opposing sides and having an axis parallel to the elongated housing axis; and an indicator element disposed and freely moveable within said annulus, such that upon rotation of said elongated housing said indicator element responds to gravitational forces and moves along the annulus to a location closest to the source of the gravitational forces, and upon sufficient convergence of said opposing sides, said indicator element is squeezed between said opposing sides and is locked into a stationary position.

2. The apparatus of claim 1 wherein said stationary position is the lowest location within said annulus.

3. The apparatus of claim 1 further comprising a mark within said annulus coinciding with the calculated annulus low point, where the angular difference between the line connecting the mark to the axis of said annulus and the line connecting the stationary point to the axis of said housing equals the actual orientation displacement.

4. The apparatus of claim 1 where said inner surface and said outer surface are parallel to the axis of said annulus.

5. The apparatus of claim 1 further comprising a detonation cord inside the inner surface of said annulus.

6. The apparatus of claim 5 where detonation of the detonation cord deforms the inner surface of said annulus toward the outer surface of said annulus thereby locking said indication device in the stationary position.

7. The apparatus of claim 1, wherein said indicator element is substantially spherical.

8. The apparatus of claim 1, wherein said indicator element is substantially cylindrical.

9. The apparatus of claim 1 further comprising a means for converging the opposing sides of said annulus.

10. A method of indicating a perforating gun shot direction comprising:

forming an indicator housing having an annulus produced within an inner surface and an outer surface that form opposing sides;

adapting an indicator element to pass freely along said annulus;

disposing said indicator element within said annulus;

securing said indicator housing within a perforating gun having shaped charges such that the axis of said annulus is parallel to the longitudinal axis of the perforating gun;

inserting the perforating gun within a wellbore to a location where the shaped charges are to be detonated;

detonating the shaped charges while simultaneously converging the opposing sides of said annulus against said indicator element and locking the indicator element into a stationary position;

examining the location of the stationary position with respect to the perforating gun and the shaped charges; and determining the orientation of the perforating gun at the time the shaped charges were detonated based on the location of the stationary position.

* * * * *

UNITED STATES PATENT AND TRADEMARK OFFICE

CERTIFICATE OF CORRECTION

PATENT NO. : 7,044,236 B2
APPLICATION NO. : 10/028082
DATED : May 16, 2006
INVENTOR(S) : Morten Iversen et al.

It is certified that error appears in the above-identified patent and that said Letters Patent is hereby corrected as shown below:

Title Page,
Item 75 Inventors - Delete Morten Iverson, Bergen (NO)

Signed and Sealed this

Fifth Day of December, 2006

JON W. DUDAS
*Director of the United States Patent and Trademark Office*